US005421677A

United States Patent [19]

Adam et al.

[11] Patent Number: 5,421,677

[45] Date of Patent: Jun. 6, 1995

[54] PROCESS FOR FORMING A DITCH LINER

[75] Inventors: Norbert J. Adam, Pittsburgh; Jerome B. LeFebvre, Aliquippa, both of Pa.

[73] Assignee: Miles Inc., Pittsburgh, Pa.

[21] Appl. No.: 224,456

[22] Filed: Apr. 7, 1994

[51] Int. Cl.[6] ..... E02B 3/00

[52] U.S. Cl. ..... 405/270; 405/118; 405/264

[58] Field of Search ..... 405/38, 52, 118, 129, 405/258, 264, 268, 270, 303; 156/71, 331.4, 331.7

[56] References Cited

U.S. PATENT DOCUMENTS

| | | | |
|---|---|---|---|
| 3,940,940 | 3/1976 | Barrett | 405/270 |
| 4,787,776 | 11/1988 | Brady et al. | 405/270 |
| 4,828,432 | 5/1989 | Ives | 405/270 |
| 4,872,784 | 10/1989 | Payne | 405/270 |
| 4,955,759 | 9/1990 | Payne | 405/270 |
| 4,955,760 | 9/1990 | Payne | 405/270 |
| 5,049,006 | 9/1991 | Payne | 405/270 |
| 5,062,740 | 11/1991 | Payne | 405/270 |
| 5,145,282 | 9/1992 | Payne | 405/155 |
| 5,160,221 | 11/1992 | Rohe et al. | 405/270 |

*Primary Examiner*—David H. Corbin
*Attorney, Agent, or Firm*—Joseph C. Gil

[57] ABSTRACT

The invention is directed to a process of forming a ditch liner by dispensing a solidifiable liquid mixture onto a continuously moving porous blanket, applying pressure against the mixture and the coated blanket to form a continuous matrix within the blanket, laying the resulting coated blanket into a ditch before the liquid mixture has fully cured, conforming the coated blanket to the shape of the ditch, and allowing the mixture to fully cure. The improvement resides in using a reaction mixture of a polyisocyanate, up to 60% by weight of a filler, a specified polyol mixture and, optionally, a catalyst. The polyol mixture requires three different propylene oxide adducts: i) a propylene oxide adduct of an alkanolamine, ii) a propylene oxide adduct of a low molecular weight organic compound having from 3 to 8 OH groups, and iii) a propylene oxide adduct of a low molecular weight diol. The amounts of ii) and iii) are such that the mixture of ii) and iii) has an average OH functionality of from more than 2 to less than 2.8.

6 Claims, No Drawings

PROCESS FOR FORMING A DITCH LINER

BACKGROUND OF THE INVENTION

Apparatus methods of forming ditch liners are known. See, e.g., U.S. Pat. Nos. 4,872,784, 4,955,759, 4,955,760, 5,049,006, 5,062,740 and 5,145,282. These patents broadly describe a process comprising dispensing a solidifiable liquid mixture onto a continuously moving porous blanket, applying pressure against the mixture and coated blanket to form a continuous matrix within the blanket, laying the resulting coated blanket into a ditch before the liquid mixture has fully cured, conforming the coated blanket to the shape of the ditch, and allowing the mixture to fully cure.

The above noted patents give almost no guidelines as to solidifiable compositions which should be used. For example, the '784 patent (at column 5, lines 55–60), the '759 patent (at column 5, lines 58–63), the '760 patent (at column 4, lines 55–60)and the '740 patent (at column 4, lines 56–61) broadly suggest the use of a foamed polyurethane resin without describing any specific formulations. The '006 patent (at column 4, lines 26–32) and the '282 patent (at column 5, line 64—column 6, line 2) broadly suggest the use of a thermosetting resin forming mixture such as a polyester or a polyurethane forming mixture, without describing any specific formulations.

In actual practice, the solidifiable liquid mixture to be used in the process must be curable over a wide range of temperatures. Thus, for example, the composition must be curable at temperatures as low as 15° F. and as high as 120° F. depending upon the climate of the region where the ditch is being lined. Furthermore, the mixture must generally be curable within a reasonable amount of time (typically from 5 to 30 minutes) without any application of externally applied heat. The object of the present invention was the development of a composition which would meet these conditions of curing times and temperatures.

DESCRIPTION OF THE INVENTION

The present invention is directed to an improved process of forming a ditch liner comprising dispensing a solidifiable liquid mixture onto a continuously moving porous blanket applying pressure against said mixture and said coated blanket to form a continuous matrix within said blanket, laying the resulting coated blanket into a ditch before said liquid mixture has fully cured, conforming said coated blanket to the shape of the ditch, and allowing said mixture to fully cure, the improvement wherein said mixture comprises:

a) one or more polyisocyanates, b) one or more fillers in an amount of up to 60% by weight based upon the total weight of said mixture (and preferably in an amount of from 20 to 40% by weight), c) a polyol mixture comprising:

i) from 5 to 15 parts by weight of a propylene oxide adduct of an alkanolamine, said adduct i) having a molecular weight of up to 1000 (and preferably a molecular weight of from 400 to 600), ii) one or more propylene oxide adducts of a low molecular weight organic compound having from 3 to 8 OH groups (preferably having 3 or 4 OH groups). said adduct ii) having a molecular weight of no more than 1000 (and preferably a molecular weight of from 600 to 800), of from 1500 to 2500), with the proviso that:

1 ) the amounts of components ii) and iii) are such that the mixture of component ii) and iii) has an average OH functionality of from more than 2 to less than 2.8, 2) neither component ii) nor component iii) contain any nitrogen atoms, and 3) the amounts of components a) and c) are such that the NCO:OH equivalent ratio is from 1.4:1 to 0.9:1 (and preferably from 1.2:1 to 1.1:1), and d) from 0 to 0.1 parts by weight (and preferably from 0.01 to 0.05 parts by weight) per hundred parts by weight of said polyol mixture of a catalyst for catalyzing the reaction between hydroxyl groups and isocyanate groups, with the further proviso that the reaction mixture contains no more than 0.1% by weight of water and contains no material which would catalyze the reaction between an isocyanate group and water.

The above described composition cures in a reasonable amount of time without application of any externally applied heat and under temperature conditions varying over a range of from 15° to 120° F.

The basic process and equipment to be used therewith are known and are described in U.S. Pat. Nos. 4,872,784, 4,955,759, 4,955,760, 5,049,006, 5,062,740 and 5,145,282, all the disclosures of which are hereby incorporated by reference.

The various materials used in the composition used in the present invention are also generally known in the art. The composition of the present invention requires a) one or more polyisocyanates, b) one or more fillers, c) a polyol mixture and d) a catalyst.

The isocyanates useful herein are known. Suitable organic polyisocyanates include aliphatic, cycloaliphatic, araliphatic, aromatic, and heterocyclic polyisocyanates of the type described, for example, by W. Siefken in *Justus Liebigs Annalen der Chemie,* 562, pages 75 to 136. Such isocyanates include those having the formula $$Q(NCO)_n$$

in which n is a number from 2 to about 5 (preferably 2 to 3) and Q is an aliphatic hydrocarbon group containing 2 to about 18 (preferably 6 to 10) carbon atoms, a cycloaliphatic hydrocarbon group containing 4 to about 15 (preferably 5 to 10) carbon atoms, an araliphatic hydrocarbon group containing 8 to 15 (preferably 8 to 13) carbon atoms, or an aromatic hydrocarbon group containing 6 to about 15 (preferably 6 to 13) carbon atoms. Examples of suitable isocyanates include ethylene diisocyanate; 1,4-tetramethylene diisocyanate; 1,6-hexamethylene diisocyanate; 1,12-dodecane diisocyanate; cyclobutane-1,3-diisocyanate; cyclohexane-1,3- and 1,4-diisocyanate, and mixtures of these isomers; 1-isocyanato-3,3,5-trimethyl-5-isocyanatomethylcyclohexane ("isophorone diisocyanate"; see, e.g. German Auslegeschrifi 1,202,785 and U.S. Pat. No. 3,401,190); 2,4- and 2,6-hexahydrotoluene diisocyanate and mixtures of these isomers; dicyclohexylmethane-4,4'-diisocyanate ("hydrogenated MDI", or "HMDI"); 1,3- and 1,4-phenylene diisocyanate; 2,4- and 2,6-toluene diisocyanate and mixtures of these isomers ("TDI"); diphenylmethane-2,4'- and/or -4,4'-diisocyanate ("MDI"); naphthylene-1,5-diisocyanate; triphenylmethane-4,4',4''-tdisocyanate; polyphenyl-polymethylene-polyisocyanates of the type which may be obtained by condensing aniline with formaldehyde, followed by phosgenation ("crude MDI"), which are described, for example, in British Patents 878,430 and 848,671; norbornane diisocyanates, such as described in U.S. Pat. No. 3,492,330; m- and p-isocyanatophenyl sulfonylisocyanates of the type described in U.S. Pat. No. 3,454,606; perchlorinated aryl polyisocyanates of the type described, for example, in U.S. Pat. No. 3,227,138; modified polyisocyanates containing carbodiimide groups of the type described in U.S. Pat. No. 3,152,162; modified polyisocyanates containing urethane groups of the type described, for example, in U.S. Pat. Nos. 3,394,164 and 3,644,457; modified polyisocyanates containing allophanate groups of the type described, for example, in British Patent 994,890, Belgian Patent 761,616, and published Dutch Patent Application 7,102,524; modified polyisocyanates containing isocyanurate groups of the type described, for example, in U.S. Pat. No. 3,002,973, German Patentschrifien 1,022,789, 1,222,067 and 1,027,394, and German Offenlegungsschrifien 1,919,034 and 2,004,048; modified polyisocyanates containing urea groups of the type described in German Patentschrifi 1,230,778; polyisocyanates containing biuret groups of the type described, for example, in German Patentschrifi 1,101,394, U.S. Pat. Nos. 3,124,605 and 3,201,372, and in British Patent 889,050; polyisocyanates obtained by telomerization reactions of the type described, for example, in U.S. Pat. No. 3,654,106; polyisocyanates containing ester groups of the type described, for example, in British Patents 965,474 and 1,072,956, in U.S. Pat. No. 3,567,763, and in German Patentschrifi 1,231,688; reaction products of the above-mentioned isocyanates with acetals as described in German Patentschrifi 1,072,385; and polyisocyanates containing polymeric fatty acid groups of the type described in U.S. Pat. No. 3,455,883. It is also possible to use the isocyanate-containing distillation residues accumulating in the production of isocyanates on a commercial scale, optionally in solution in one or more of the polyisocyanates mentioned above. It is also possible to use mixtures of the polyisocyanates described above.

In general, it is preferred to use readily available polyisocyanates, such as 2,4- and 2,6-toluene diisocyanates and mixtures of these isomers ("TDI"); polyphenyl-polymethylene-polyisocyanates of the type obtained by condensing aniline with formaldehyde, followed by phosgenation ("crude MDI"); and polyisocyanates containing carbodiimide groups, urethane groups, allophanate groups, isocyanurate groups, urea groups, or biuret groups ("modified polyisocyanates"). The commercially available phosgenation products of aniline/formaldehyde condensates are the most preferred isocyanates to be used in the present invention.

The fillers useful herein are also known. Useful fillers include calcium carbonate, barium sulfate, kieselguhr, whiting, mica, glass fibers, liquid crystal fibers, glass flakes, glass balls, aramide fibers, and carbon fibers. In addition, ground solid plastics (such as polyurethane scrap) and rubber wastes (such as from tires) of substantially any kind may also be used. Ground rubber is the presently preferred filler.

The polyol mixture c) of the present invention comprises the following three specific components: i) an adduct of a mono-, di-, or trialkanolamine and propylene oxide, said adduct having a molecular weight of up to 1000 (and preferably having a molecular weight of from 400 to 600), ii) one or more propylene oxide adducts of a low molecular weight organic compound having from 3 to 8 OH groups, said adducts having a molecular weight of no more than 1000 (and preferably from 600 to 800), and iii) a propylene oxide adduct of a low molecular weight diol, said adduct having a molecular weight of no more than 3000 (and preferably from 1500 to 2500). The mixture generally contains from 5 to 15 parts by weight of component c)i).

The polyols used in mixture c) and their methods of manufacture are generally known in the art. These are produced by the addition of propylene oxide to compounds containing reactive hydrogen atoms. Examples of suitable organic compounds containing 3 to 8 OH groups for the production of component c)ii) include glycerin, trimethylolpropane, pentaerythritol, sorbitol, sucrose and the like. Suitable low molecular weight diols for the production of component c)iii) include propylene glycol, ethylene glycol, butane diol (and its various isomers), hexane diol (and its various isomers) and the like. Mono-, di- and trialkanolamines are used to produce component c)i). Suitable alkanolamines include mono-, di- and triethanolamine, mono-, di-, and triisopropanolamine, and the like. As noted above, components c)ii) and c)iii) do not contain any nitrogen atoms. Further more, the amounts of components c)ii) and c)iii) are such that the average OH functionality of the mixture of components c)ii) and c)iii) is from more than 2 to less than 2.8.

The reaction mixture also contains a catalyst d) for catalyzing the reaction between isocyanate groups and hydroxyl groups (i.e., a urethane catalyst). Such catalysts are well known in the art. Furthermore, the composition must not contain a catalyst which would catalyze the reaction between an isocyanate group and water. Preferred catalysts d) are organic tin compounds. The organic tin compounds used are preferably tin(II) salts of carboxylic acids such as tin(II) acetate, tin(II) octoate, tin(II) ethyl hexoate and tin(II) laurate and tin(IV) compounds such as dibutyl tin oxide, dibutyl tin dichloride, dibutyl tin diacetate, dibutyl tin dilaurate, dibutyl tin maleate, dioctyl tin diacetate and the like.

The invention is further illustrated but is not intended to be limited by the following example in which all parts and percentages are by weight unless otherwise specified.

EXAMPLE

The following formulation was used on a machine as described in U.S. Pat. No. 4,872,784 at a field location where an irrigation ditch was lined.

Composition of the B-side:

| | |
|---|---|
| 10 pbw | a 480 molecular weight adduct of propylene oxide and monoethanolamine (OH number 350) |
| 45 pbw | a 670 molecular weight adduct of propylene oxide and glycerin (OH number 250) |
| 45 pbw | a 2000 molecular weight adduct of propylene oxide and propylene glycol (OH number 56) |
| 0.02 pbw | Fomrez UL-28, a commercially available tin catalyst sold by Witco. |

100 parts of the above noted B-side were mixed with 46.5 parts of Mondur MRS isocyanate (a commercially available polymethylene poly(phenyl isocyanate) from Miles Inc., having an NCO content of 31.6% by weight and a Brookfield viscosity at 25° C. of 200 mPa.s) and 50 parts of a ground rubber.

The three components were metered separately into the mixing head. From the mixing head the reaction mixture was poured on the fabric substrate. The fabric with the reaction mix on top was pulled under a doctor blade to distribute the reaction mix evenly on the fabric. The coated fabric was cut to needed length and placed in the ditch.

The temperature of the two liquid components (i.e., the B-side and the isocyanate) was adjusted to about 65° F., allowing for the distribution of the reaction mix on the fabric prior to the increase of viscosity due to the reaction of the polyol with the isocyanate. The material gelled on the fabric.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. In a process of forming a ditch liner comprising dispensing a solidifiable liquid mixture onto a continuously moving porous blanket, applying pressure against said mixture and said coated blanket to form a continuous matrix within said blanket, laying the resulting coated blanket into a ditch before said liquid mixture has fully cured, conforming said coated blanket to the shape of the ditch, and allowing said mixture to fully cure, the improvement wherein said mixture comprises:

a) one or more polyisocyanates, b) one or more fillers in an amount of up to 60% by weight based upon the total weight of said mixture, c) a polyol mixture comprising:

i) from 5 to 15 parts by weight of a propylene oxide adduct of an alkanolamine, said adduct i) having a molecular weight of up to 1000, ii) one or more propylene oxide adducts of a low molecular weight organic compound having from 3 to 8 OH groups, said adduct ii) having a molecular weight of no more than 1000, iii) a propylene oxide adduct of a low molecular weight diol, said adduct iii) having a molecular weight of no more than 3000, with the proviso that:

1) the amounts of components ii) and iii) are such that the mixture of component ii) and iii) has an average OH functionality of from more than 2 to less than 2.8, 2) neither component ii) nor component iii) contain any nitrogen atoms, and 3) the amounts of components a) and c) are such that the NCO:OH equivalent ratio is from 1.4:1 to 0.9:1, and d) from 0 to 0.1 parts by weight per hundred parts by weight of said polyol mixture of a catalyst for catalyzing the reaction between hydroxyl groups and isocyanate groups, with the further proviso that the reaction mixture contains no more than 0.1% by weight of water and contains no catalyst which would catalyze the reaction between an isocyanate group and water.

2. The process of claim 1, wherein the amount of filler b) comprises from 20 to 40% by weight.

3. The process of claim 1, wherein the molecular weight of component c)i) is from 400 to 600, the molecular weight of component c)ii) is from 600 to 800, and the molecular weight of component c)iii) is from 1500 to 2500.

4. The process of claim 1, wherein said equivalent ratio is from 1.2:1 to 1.1:1.

5. The process of claim 1, wherein the amount of said catalyst is from 0.01 to 0.05 parts by weight.

6. The process of claim 1, wherein component c)ii) has 3 or 4 OH groups.

* * * * *

UNITED STATES PATENT AND TRADEMARK OFFICE

CERTIFICATE OF CORRECTION

PATENT NO. : 5,421,677
DATED : June 6, 1995
INVENTOR(S) : Norbert J. Adam and Jerome B. LeFebvre It is certified that error appears in the above-identified patent and that said Letters Patent is hereby corrected as shown below:

Column 1,
Line 6, insert -- and -- after "Apparatus".
Line 67, delete "." and insert -- , --.

Column 2,
Line 1, after the comma insert -- iii) a propylene oxide adduct of a low molecular weight diol, said adduct iii) having a molecular weight of no more than 3000 (and preferably a molecular weight --.

Column 3,
Line 1, delete "tdisocyanate" and insert -- triisocyanate --.

Signed and Sealed this

Twenty-fourth Day of June, 2003

JAMES E. ROGAN
*Director of the United States Patent and Trademark Office*